US010661108B2

(12) United States Patent
Hong et al.

(10) Patent No.: US 10,661,108 B2
(45) Date of Patent: May 26, 2020

(54) FLAME ARRESTERS

(71) Applicant: ELMAC TECHNOLOGIES LIMITED, Flintshire (GB)

(72) Inventors: Daomin Hong, Flintshire (GB); Lewis Bingham, Flintshire (GB)

(73) Assignee: Elmac Technologies Limited, Flintshire (GB)

( * ) Notice: Subject to any disclaimer, the term of this patent is extended or adjusted under 35 U.S.C. 154(b) by 149 days.

(21) Appl. No.: 15/516,578

(22) PCT Filed: Oct. 5, 2015

(86) PCT No.: PCT/GB2015/052903
§ 371 (c)(1),
(2) Date: Apr. 3, 2017

(87) PCT Pub. No.: WO2016/051209
PCT Pub. Date: Apr. 7, 2016

(65) Prior Publication Data

US 2018/0264300 A1 Sep. 20, 2018

(30) Foreign Application Priority Data

Oct. 3, 2014 (GB) ..... 1417544.2

(51) Int. Cl.
*A62C 4/02* (2006.01)

(52) U.S. Cl.
CPC ..... *A62C 4/02* (2013.01)

(58) Field of Classification Search
CPC ..... A62C 4/00; A62C 4/02
(Continued)

(56) References Cited

U.S. PATENT DOCUMENTS 1,784,067 A 12/1930 Holtson
2,160,684 A * 5/1939 Spaeth ..... A62C 4/00 220/88.2

(Continued)

FOREIGN PATENT DOCUMENTS

DE 461980 C 7/1928
DE 482406 C 9/1929

(Continued)

OTHER PUBLICATIONS

International Search Report for PCT/GB2015/052903, dated Jan. 18, 2016.

(Continued)

*Primary Examiner* — Jeffrey R Allen
(74) *Attorney, Agent, or Firm* — Curatolo Sidoti Co., LPA; Salvatore A. Sidoti; Floyd Trillis, III

(57) ABSTRACT

A flame arrester 10, the flame arrester 10 having a housing 2 in which there is provided a flame arrester element 3 and into which extends a conduit 1, a portion of the conduit being at least partially surrounded by the flame arrester element 3 and wherein the conduit 1 has a principal flow axis extending along the conduit for flow of gas into or out of the flame arrester 10 and the flame arrester element 3 has a principal flow axis for flow of gas out of or in to the flame arrester 10, the principal flow axis along said portion and the principal flow axis through the flame arrester element 3 extending in opposite directions and wherein the conduit 1 has a cross sectional area A and, at a working surface, the flame arrester element 3 has a cross sectional area of A or above.

20 Claims, 5 Drawing Sheets

(58) Field of Classification Search
USPC ..... 220/88.2
See application file for complete search history.

(56) References Cited

U.S. PATENT DOCUMENTS

| | | | | |
|---|---|---|---|---|
| 2,894,530 | A | 7/1959 | Stevens et al. | |
| 3,472,419 | A * | 10/1969 | King | A62C 4/00 220/88.2 |
| 4,317,868 | A | 3/1982 | Spiegelberg | |
| 4,909,730 | A * | 3/1990 | Roussakis | A62C 4/00 138/42 |
| 2005/0113018 | A1 | 5/2005 | Knyrim et al. | |

FOREIGN PATENT DOCUMENTS

| | | | |
|---|---|---|---|
| DE | 1125847 | B | 3/1962 |
| DE | 1203686 | B | 10/1965 |
| EP | 1586350 | A1 | 10/2005 |
| JP | 2012239573 | A | 12/2012 |

OTHER PUBLICATIONS

International Written Opinion for PCT/GB2015/052903, dated Jan. 18, 2016.
Great Britain Search Report for GB1417544.2, dated Mar. 12, 2015.

* cited by examiner

FLAME ARRESTERS

CROSS REFERENCE TO RELATED APPLICATIONS

This application is a national stage application of International Application No. PCT/GB2015/052903, filed 5 Oct. 2015, which claims priority from Great Britain Patent Application No. GB1417544.2, filed 3 Oct. 2014, both of which applications are incorporated herein by reference.

This invention relates to flame arresters.

A vapour cloud may form an explosive atmosphere in the vicinity of industrial equipment. An ignition of this vapour cloud (due to sparks, lightning, static electricity etc.) will initiate an atmospheric deflagration or a vapour cloud explosion which may enter a vent pipe and cause a subsequent explosion in the piping and, for example, a downstream (in the direction of flame propagation) tank system. Typical installations in which such events may be encountered include tank venting systems including those found in petrol station forecourts.

Furthermore, an explosive mixture within a conduit, such as a system of pipework and other equipment, may be ignited, resulting initially in the propagation of a deflagration and, possibly, a transition to a detonation. Typical applications in which such events may be encountered include vapour recovery systems.

It is essential that such risks of explosion propagation are mitigated. A variety of technologies exist for this purpose, especially flame arresters, which are recognised as a very convenient, simple and effective solution to these challenges.

A flame arrester comprises a flame arrester element which is constructed from a porous matrix, typically in a crimped ribbon form, which allows gas or vapour to flow through the flame arrester. The flame arrester element is designed principally to prevent flame transmission in the event of an explosion.

There are two basic types of flame arrester: in-line and end-of-line (EOL). An EOL flame arrester protects plant and equipment from an externally ignited atmospheric deflagration, preventing the flame front from entering into, and propagating through, a piping system. An in-line flame arrester protects against in-line explosions by preventing the transmission of a flame within the piping system or equipment.

A common problem experienced with conventional EOL flame arresters concerns the routine maintenance and visual inspection of the flame arrester element, which is usually hidden by a weather hood. Regular maintenance and inspections are vital to prevent blockage of the flame arrester element and to ensure that it operates effectively under normal flow conditions and also in the event of an explosion.

EOL flame arresters are used in a variety of applications, and often at the end of a vertical vent pipe which may be distant from ground level. A typical application is the protection of vent pipes from underground storage tanks in petrol station forecourts. For maintenance purposes, it is vital that the condition of the flame arrester element is visually inspected on a regular basis. Therefore, it is helpful if the flame arrester element is visible from ground level, and certainly without having to dismantle the equipment.

Flame arresters are susceptible to becoming blocked. Such blockages may occur in a variety of different ways: for example, airborne solids may be deposited on the face of the flame arrester element, moisture may condense and freeze on the flame arrester element surface under the right meteorological conditions, and flame arrester elements are also attractive for nesting birds and bees/wasps which may cause total blockage to the vent system. If a flame arrester becomes blocked, the flame arrester flow capacity will be reduced and, in extreme cases, there will be a serious risk of catastrophic damage to equipment (for example, to storage tanks during filling and emptying or as a result of weather changes).

A further common disadvantage of conventional EOL flame arresters is that foreign solids and/or liquids may be transported into the piping system under gravitational forces with the potential that the process fluids become contaminated.

Conventional EOL flame arresters usually allow a gas stream to vent out in a vertical orientation, through a flame arrester element which is exposed to the atmosphere on its upper, downstream surface. The flame arrester element is typically protected from exposure to atmospheric contaminants by means of a weather hood. An alternative configuration is to vent out the gas horizontally (e.g. through a stacked plate pack of solid annular rings) by turning the gas flow through 90 degrees within the flame arrester. The effect of these configurations is to obscure the external face (i.e. in normal out-breathing mode, the downstream face) of the flame arrester element from sight, especially when the flame arrester is significantly elevated above ground level. This is disadvantageous. Furthermore, these devices suffer a further disadvantage of having to be installed vertically to avoid ingress of precipitation and/or airborne solids etc.

To overcome these disadvantages, many installations fit a conventional EOL flame arrester at the end of a goose-neck connection.

There are several disadvantages to an arrangement incorporating a goose-neck connection. In addition to increased costs and larger space requirements, the gas flow may well be poorly distributed across the flame arrester element, thus increasing the pressure drop and potentially requiring a larger, heavier and more costly flame arrester.

In certain in-line flame arresters (e.g. EP1586350B) it is known to provide as a flame arrester element a stack of plates which is sealed at one end to encourage gas to flow into and out of the flame arrester element in orthogonal directions. Whilst this allows for variation in the flow characteristics it also means that proper and effective visual inspection of the flame arrester element may require complete dismantling of the flame arrester.

It is an object of this invention to provide a new flame arrester which is one or more of easy to install and/or inspect, compact, robust and effective and/or which has improved performance (for example improved flow distribution) over and/or less downtime than prior art flame arresters.

It is a further object to provide a flame arrester, for example an in-line flame arrester, which has improved performance over prior art in-line flame arresters and/or a flame arrester which is more robust, for example where the flame arrester element is protected.

Aspects of the invention relate to a flame arrester through which the principal flow direction is altered, preferably reversed. Aspects of the invention may further relate to a flame arrester arranged to contain a travelling flame front, including a deflagration or detonation, in a container, piping system or other equipment.

The reverse flow principle embodied in this aspect of the invention may also be used in EOL and in-line flame arresters.

Accordingly, a first aspect of the invention provides a flame arrester, the flame arrester having a housing in which there is provided a flame arrester element and into which extends a conduit, a portion of the conduit being surrounded by the flame arrester element and wherein the conduit has a principal flow axis extending along the conduit for flow of gas into or out of the flame arrester and the flame arrester element has a principal flow axis for flow of gas out of or in to the flame arrester, the principal flow axis along said portion and the principal flow axis through the flame arrester element extending in opposite directions and wherein the conduit has a cross sectional area A and, at a working surface, the flame arrester element has a cross sectional area of A or above.

A further aspect of the invention provides a flame arrester, the flame arrester comprising a gas flow conduit, a housing and a flame arrester element, wherein the flame arrester element at least partially surrounds, and preferably completely surrounds, the gas flow conduit such that, in use, a flow passage for gas extends along the entirety of the gas flow conduit, into a flow volume within the housing, which flow volume has a larger cross sectional area than the gas flow conduit, and through the flame arrester element.

The flame arrester element preferably radiates away from the conduit, either orthogonally to the principal axis of the conduit or at an angle thereto.

Preferably, the flow passage along the gas flow conduit extends in an opposite direction to the flow passage through the flame arrester element.

An aspect of the invention provides a flame arrester, the flame arrester having a housing or chamber in which there is provided a flame arrester element and into which extends a conduit, the conduit being at least partially surrounded by the flame arrester element and wherein the conduit has a principal flow axis or flow direction extending along the conduit for flow of gas into or out of the flame arrester and/or through the flame arrester element and the flame arrester element has a principal flow axis or direction for flow of gas out of or in to the flame arrester and/or through the flame arrester element, the principal flow axes or directions extending in opposite directions.

In this specification the term "extending (or extend) in opposite direction(s)" includes principal flow axes which describe an acute angle therebetween and, as such, the flow path along the principal flow axes describes an at least partial reversal in the direction of flow.

The flame arrester element may extend radially from the conduit, and/or substantially orthogonally to the principal flow axis. In this regard, 'orthogonally' and 'substantially orthogonally' need not have their strict mathematical meaning, e.g. the flame arrester element could be inclined at an angle of greater than or less than 90° to the principal flow axis.

The flame arrester element may have an upstream face and a downstream face as determined by the direction of flowing gas, in an out-breathing mode the upstream face preferably facing the flow volume. In an in-breathing mode the downstream face will face the flow volume.

The conduit may protrude beyond the flame arrester element, for example, it may extend above the level of the upstream and/or downstream face of the flame arrester element. The conduit may protrude into the flow volume. The protrusion of the conduit may contain at least one aperture. The one or more apertures may extend through a side wall, for example the apertures may extend radially with regard to the principal flow axis. Additionally or alternatively, the end of the conduit may be closed by a closure, which itself may be provided with one or more apertures.

This may be advantageous insofar as the or any apertures within the conduit may be able to contribute to the distribution of flow within the flow volume.

The housing may have one or more of, one or more traps, for example a particulates trap, for example to remove entrained solid particulates or liquid droplets from the gas or vapour flow, a liquid drain, for example to remove entrained liquids from the gas or vapour flow, cleaning means, for example nozzles arranged, preferably, to discharge, e.g. to force, periodically, a cleaning medium into the flow volume and/or through the flame arrester element. The cleaning medium may comprise a gas or liquid, for example a compressed gas or a cleaning liquid to remove matter within the flame arrester element.

Having a liquid drain may be particularly advantageous as it reduces the likelihood of liquid pooling on a facing surface, for example the or an upstream surface of the flame arrester element and/or the collection of liquid within the porous media itself. Any such liquid can partially or completely occlude the flame arrester element, thereby impeding the flow through, into and/or out of the system and ultimately increasing the pressure or vacuum within the system. This problem may be exacerbated by freezing of the liquid in cold climates. Moreover, the trap, e.g. the particulates trap, can reduce the likelihood of particulates partially or completely blocking the flame arrester element. Either or both of the particulates trap and liquids drain is preferably located at least partially in the line-of-sight of the conduit.

The cleaning means may be, at least partially (and in some cases exclusively) disposed on a side wall of the housing, and or on a top wall of the housing, in either and/or both cases the cleaning means being downstream of the flame arrester element in out-breathing mode.

The flame arrester element may be concentrically or eccentrically located about the conduit. The conduit may have a cross sectional area which is circular, elliptical, polygonal, regular or irregular.

The housing may be shaped so as to facilitate drainage, in use, and/or to house the trap, and/or may have an internal surface shaped so as to effect a well distributed fluid flow within the flow volume.

The conduit (preferably when configured as an inlet conduit) may be provided with a bursting disc and/or a pressure relief valve. The conduit may be provided with a biased pressure relief valve, for example a weight-loaded or spring-loaded pressure relief valve. The biased pressure relief valve may be provided at an end of the conduit, for example within the housing.

The housing may be provided with an integrated pressure relief valve, vacuum relief valve or pressure and vacuum relief valve, for example, downstream of the conduit (preferably an inlet conduit), but upstream of the flame arrester element, and/or within the housing.

The conduit may have an external diameter (or transverse dimension) D and/or a cross sectional area A, the flame arrester element may have an external diameter (or transverse dimension) of at least 2.25 D, and/or may have a cross sectional area of at least 4.06 A. Alternatively, the flame arrester element may have, at its free working surface, a cross sectional (or surface) area of less than A or greater than A, for example 2 A, 3 A. Thus the cress sectional area of the flame arrester element may be from 0.5 A to 10 A.

The flame arrester may be provided as an in-line or EOL flame arrester.

A yet further aspect of the invention provides a method of forming a flame arrester, the method comprising securing an elongate element, for example an elongate plastics or metal element, about a tube to provide a flame arrester element and locating the tube and flame arrester element within a housing to define a space between an end wall of the housing and the facing surface of the flame arrester element, thereby to provide a fluid flow path into the flame arrester through the conduit into the space and through the flame arrester element out of the flame arrester.

A further aspect of the invention provides an in-line flame arrester comprising a housing having a first conduit through which gas is flowable into or out of the housing and a second conduit through which gas is flowable out of or into the housing, a flame arrester housing in fluid communication with the first and second conduit and in which a flame arrester element is located, the first conduit extending through the flame arrester element and into a flow volume defined, at least in part, by the flame arrester element housing such that, in use, gas is flowable along the first conduit, into the flow volume and towards the second conduit through the flame arrester element.

There is further provided, in another aspect of the invention a method of arresting a flame, the method comprising allowing a flame front to propagate along a conduit and to exit the conduit into a housing having a larger cross sectional area than that of the conduit whereby the flame front expands as it exits the conduit and providing an outlet from the housing through a flame arrester element located around and/or about the conduit.

In order that the invention may be more fully understood, it will now be described, by way of example only, and with reference to the accompanying drawings, in which.

Figure 1:
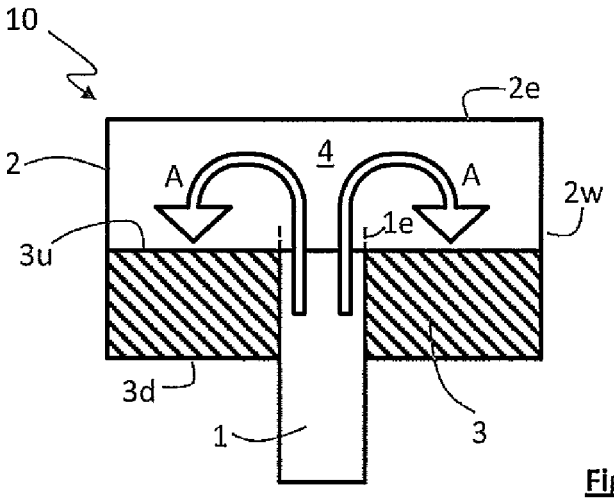
FIG. 1 is a schematic diagram showing a sectional view of an embodiment of the present invention.
Figure 1A:
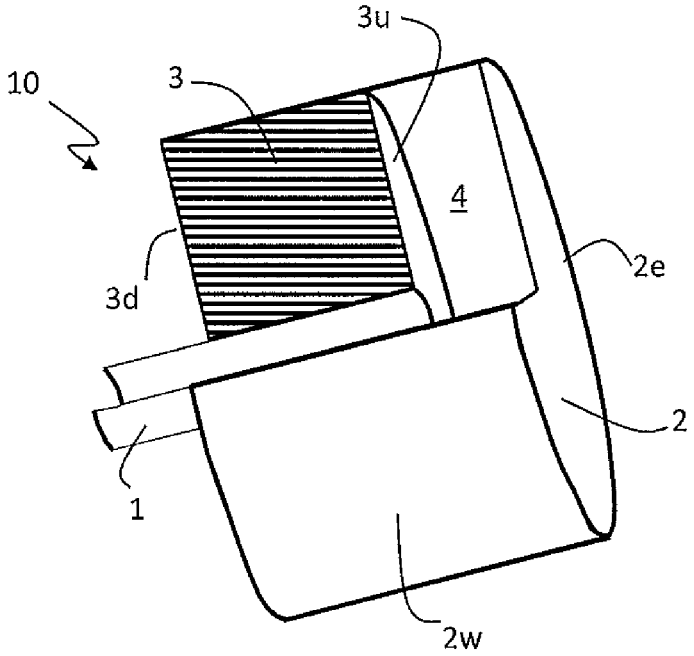
FIG. 1A is a cutaway perspective view of the flame arrester of FIG. 1.

Referring to FIGS. 1 and 1A, there is shown a flame arrester 10 according to the invention. The flame arrester 10 has a conduit 1, a housing 2 and a flame arrester element 3.

The flame arrester element 3 is located around the conduit 1 in an annular fashion. We prefer to use a crimped ribbon flame arrester element, although other flame arrester element materials or types may be used.

The crimped ribbon flame arrester element for the flame arrester element 3 may be conveniently manufactured by securing a laminate of crimped and flat ribbon to a conduit tube 1 and winding the laminate around the tube until a required amount of the laminate has been dispensed, i.e. the flame arrester element 3 is of the required size. The end of the laminate may be secured to a preceding layer, for example by brazing, spot welding, adhesives and/or mechanical fixing and the whole located within the housing 2. Alternatively, the flame arrester element 3, secured to the conduit 1, may be located within (and most preferably secured to—either permanently or removably) a flame arrester element housing (not shown) which itself is connected to a housing to form the housing 2 (this connection may be permanent but is preferably releasable). The alternate construction (with two co-joined housings to form the single housing 2) may be preferred to facilitate inspection and/or maintenance of the flame arrester element 3 or other components of the flame arrester.

The winding method is a particularly effective way of fabricating a concentric flame arrester 10 (e.g. with an annular flame arrester element 3).

The conduit 1 may extend beyond the (as shown) uppermost surface 3*u* of the flame arrester element 3 to form an optional protrusion or weir 1*e*. The protrusion may be open ended or closed and/or have radial and/or terminal apertures provided in the side wall or, when provided with an end wall, the end wall respectively.

The housing 2 is a, preferably cylindrical, body comprising a, preferably impermeable, side wall 2*w* and a closed, preferably, impermeable end wall 2*e*. In many situations, it is advantageous for the housing 2 to be detachable from the flame arrester element 3. The flame arrester element 3 is located, or housed, within the part of the housing 2 distant from the end wall 2*e*, thereby defining a flow volume 4 between the facing surfaces of the flame arrester element 3 (that is the uppermost surface 3*u*) and the end wall 2*e* of the housing 2. The flame arrester element 3 is securely located within, and may be connected to, the housing 2 such that gases egressing the flow volume 4 in the direction of Arrows A pass through the flame arrester element 3.

In outbreathing use (i.e. pressure venting), the conduit 1 will be an inlet conduit and will be provided with means to attach it to a pipe system (not shown) whereby gas or vapour can exhaust from the pipe system into the inlet conduit 1, into the flow volume 4 and through the flame arrester element 3, in the direction generally indicated by arrows A. In inbreathing use (i.e. vacuum venting), this flow path will be reversed (not shown) and the conduit 1 will be an outlet conduit.

The flame arrester 10 may be used as an EOL flame arrester, for example on a petrol tank venting system such as those found on, or associated with, petrol station forecourts.

Typically the conduit 1 will be positioned substantially vertically and the flame arrester element 3 positioned substantially horizontally. As such, the flow of gas through the flame arrester element 3 is substantially vertically downwards under outbreathing conditions. This facilitates removal of debris or matter within and/or on the flame arrester element 3, at least partially, under the effect of gravity.

Moreover, even if positioned at an angle to the vertical, the flame arrester 10 will not suffer from precipitation ingress or occlusion by falling matter, both of which might cause a blockage.

Because, in use, the (as shown) lowermost (i.e. in outbreathing mode downstream) surface 3*d* of the flame arrester element 3 is exposed to the atmosphere, it is possible to visibly inspect the flame arrester element 3 to determine if maintenance is required. Moreover, the flame arrester 10 is easy to install, may be installed vertically or at an angle to the vertical, the orientation encouraging and/or the construction allowing liquids and/or fine solids which impinge the upstream surface 3*u* of the flame arrester element 3 to fall out of the flame arrester 10 under the influence of gravity.

Moreover, because the flow of gas is reversed (i.e. the gas flows in the direction of arrows A), the flame arrester 10 is compact, requires fewer components than prior art flame arresters and is economical.

In the event of an atmospheric deflagration outside of the flame arrester 10, the flame arrester element 3 will inhibit the passage of the deflagration into the flow volume 4, thereby protecting the pipework and the material in the piping system.

In one embodiment, if the inlet conduit 1 has an external diameter D and/or has a cross sectional area A, the flame arrester element 3 may have an external diameter of at least 2.25 D, and/or has a cross sectional area of at least 4.06 A. Although the flame arrester element 3 may have, at at least one of its working surfaces, a cross sectional (or surface) area which is the same or greater than that of the conduit, it may also have on at least one of its working surfaces a cross sectional (or surface) area which is less than that of the conduit.

Whilst the Figures show the housing 2 as having a flat end wall 2*e*, the end wall 2*e* may be dished inwardly or outwardly with respect to the flame arrester element 3. Additionally or alternatively, the end wall 2*e* may have other shapes or formations, as may be required by the flow characteristics required or desired, installation issues and so on.

The conduit 1 may be circular in cross section or be elliptical, alternatively the cross section of the conduit 1 may have a regular polygonal (e.g. of 3 or more sides) or irregular shape. The cross sectional area and/or shape of the conduit may vary along its length.

In FIGS. 2 to 13, further embodiments of flame arrester are disclosed. As each has similar components, only those parts necessary to describe the embodiments will be described, the other components being the same as those of the first embodiment.

Moreover, in each of the embodiments described with reference to FIGS. 1 to 7 and 9 to 10 the flame arresters are described in terms of out-breathing operation. However, each may also be deployed under inbreathing conditions. As such 'upstream' and 'downstream' are to be construed in terms of an out-breathing mode of operation. If the flame arresters were to be deployed under inbreathing conditions the 'upstream' and 'downstream' monikers would be reversed and the 'inlet' conduit would be an 'outlet' conduit.

Figure 2:
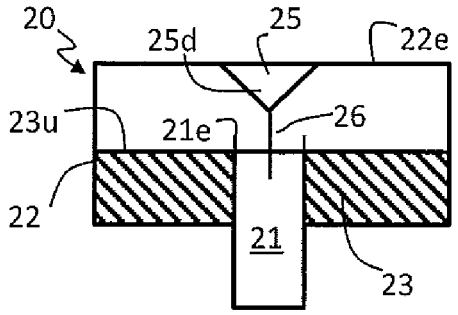
FIG. 2 is a sectional view of a second embodiment according to the invention.

Referring now to FIG. 2 (integers similar or identical to those of the first embodiment are identified by a preceding '2'), there is shown a further flame arrester 20 having a flame arrester element 23 located in, and preferably securely connected to, a housing 22. The flame arrester 20 has a liquid collector 25 located on the under-side of the top wall 22*e* of the housing 22. The liquid collector 25 preferably has a downward drainage portion 25*d* in which entrained liquid which is captured by the liquid collector 25 will drain. The liquid collector 25 may also comprise a drainage rod or tube 26 to encourage drops of liquid to fall back along the inlet conduit 21. The inlet conduit 21 may be provided with an optional extension 21*e* which protrudes beyond the flame arrester element 23. The shape of the liquid collector 25 may be used to optimise the flow distribution across the face of the flame arrester element 23*u*.

It is preferable that the liquid collector 25 is located above the inlet conduit 21 to cause or allow liquid to drip back into the conduit 21. Alternatively, the drain may be located away from the inlet conduit 21 and further liquid removal channels may be provided. Where the liquid collector 25 is located above the inlet conduit 21 it is often beneficial to include the optional extension 21*e* to further encourage any liquid falling or dripping from the liquid collector 25 to enter the conduit 21.

Figure 3:
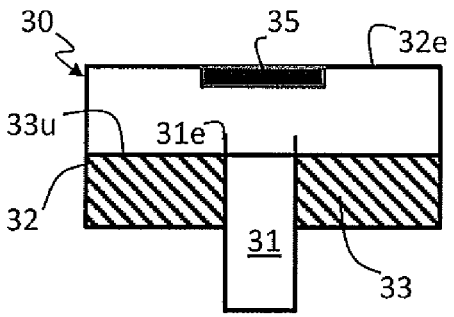
FIG. 3 is a sectional view of a third embodiment according to the invention.

Referring now to FIG. 3 (integers similar or identical to those of the first embodiment are identified by a preceding '3'), there is shown a further flame arrester 30 having a flame arrester element 33 connected to a housing 32. The inlet conduit 31 may be provided with an optional extension 31*e* which protrudes beyond the upstream surface 33*u* of the flame arrester element 33. Located on the underside of the top wall 32*e* is a particulates trap 35.

The particulates trap 35 preferably comprises a porous material which is capable, in use, of retaining particles of solid or liquid material entrained in an impinging flow of gas. The porous material may comprise or be formed of one or more of a metal mesh, for example a knitted metal mesh, an open cell ceramic or polymeric material or other filter media. The porous material should be sufficiently porous to allow, relatively unhindered, an impinging gas flow to enter the porous material but provide sufficient tortuous passages to deposit (e.g. trap) entrained particles within the porous material.

The particulates trap 35 is preferably located directly above the inlet conduit 31 to encounter particles entrained within the gas or vapour. Alternatively, the particulates trap 35 may be provided across the entirety of the end wall 32*e* and/or at another location within the housing 32.

The particulates trap 35 and liquid collector 25 could be combined in a single embodiment. For example, the liquid collector 25 could be mounted to the particulates trap 35 or the particulates trap could be mounted around the liquid collector 25.

Figure 4:
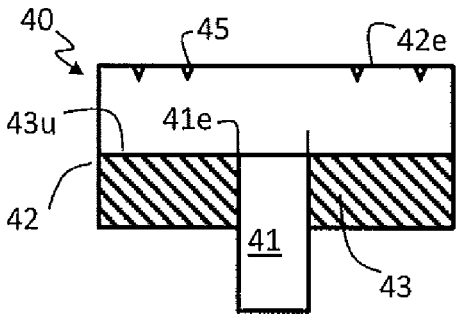
FIG. 4 is a sectional view of a fourth embodiment according to the invention.

Referring now to FIG. 4 (integers similar or identical to those of the first embodiment are identified by a preceding '4'), there is shown a further flame arrester 40 having a flame arrester element 43 connected to a housing 42. The inlet conduit 41 may be provided with an optional extension 41*e* which protrudes beyond the upstream surface 43*u* of the flame arrester element 43. Located within the housing 42 are cleaning means, for example one or more nozzles 45. The one or more nozzles 45 may be used to blow a fluid through the flame arrester element 43, for example, for the purpose of cleaning. For example, the one or more nozzles 45 may be used to blow compressed gas (for example air and/or nitrogen) and/or a cleaning liquid through the flame arrester element 43 to remove matter located or deposited therein. Alternatively or additionally, the cleaning means may be located on the side wall of the housing 42 instead of or in addition to, on the top wall 42*e*, as shown. Advantageously, the construction of the flame arrester 40 facilitates the removal of any such introduced liquid and/or small particles. Such cleaning means may be particularly advantageous for applications involving viscous liquids which may be resistant to self-drainage and in dusty environments, for example in mines or in desert conditions or in dirty environments. We believe that the cleaning means may significantly reduce blockages within the flame arrester element 3 and hence the downtime required for maintenance.

Figure 5:
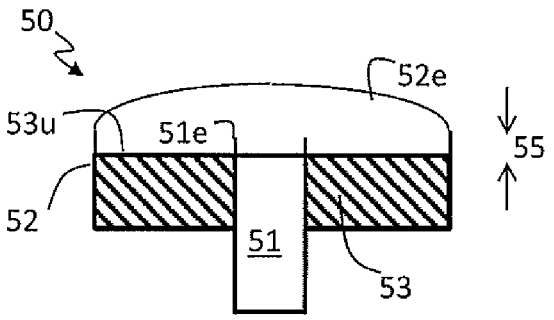
FIG. 5 is a sectional view of a fifth embodiment according to the invention.

Referring now to FIG. 5 (integers similar or identical to those of the first embodiment are identified by a preceding '5'), there is shown a further flame arrester 50 having a flame arrester element 53 connected to a housing 52. The inlet conduit 51 may be provided with an optional extension 51*e* which protrudes beyond the upstream surface 53*u* of the flame arrester element 53. In this embodiment the housing 52 has a curved end wall 52*e*, which may improve the flow distribution of gases, for example towards the, or a portion of the, periphery of the flame arrester element 53. It may be preferable that the height 55 is at least 0.5, 1.0 or 1.5 times the diameter (or length of a transverse dimension) of the inlet conduit 51. In other embodiments the height 55 may be less than 0.5, 1.0 or 1.5 times the diameter of the inlet conduit 51. In most embodiments the height 55 will be optimised to take into account pressure drop, flow capacity and flow rates (that is, particular applications of the required flow rates) and so on. Larger values of the height 55 (for example 1.5, 2.0 or 2.5 times the diameter of the conduit 51) may improve flow performance and/or may be of use when one or more of a particulates trap of liquid collector or cleaning means is present.

Figure 6:
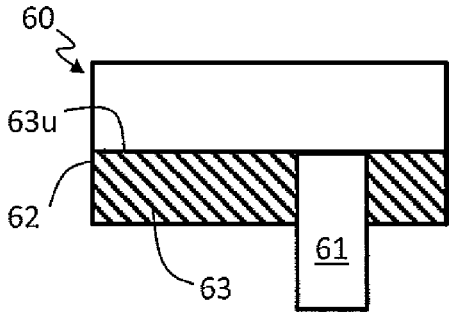
FIG. 6 is a sectional view of a sixth embodiment according to the invention.

Referring now to FIG. 6 (integers similar or identical to those of the first embodiment are identified by a preceding '6'), there is shown a further flame arrester 60 having a flame arrester element 63 located within, and preferably connected (firmly secured, attached to etc.) to, a housing 62. The inlet conduit 61 may be provided with an optional extension (not shown) which, if present, will protrude beyond the upstream surface 63*u* of the flame arrester element 63. In this embodiment, the inlet conduit 61 is eccentrically located within the flame arrester element 63, which is to say it is not positioned in the geometric centre of the flame arrester element 63. Such an eccentric design may be beneficial where space is limited for installation and may also be deployed where different flow characteristics are required. At one extreme, the inlet conduit 61 may be located at or against the wall of the housing 62.

Figure 7:
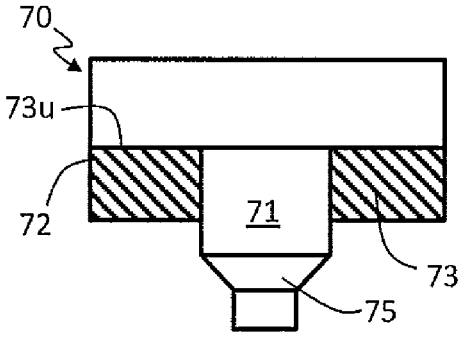
FIG. 7 is a sectional view of a seventh embodiment according to the invention.

Referring now to FIG. 7 (integers similar or identical to those of the first embodiment are identified by a preceding '7'), there is shown a further flame arrester 70 having a flame arrester element 73 located within, and preferably connected to, a housing 72. The inlet conduit 71 may be provided with an optional extension (not shown) which, if present, will protrude beyond the upstream surface 73*u* of the flame arrester element 73. The inlet conduit 71 may be provided with an expansion fitting 75 to allow connection to smaller or larger (not shown) pipe work.

Figure 8:
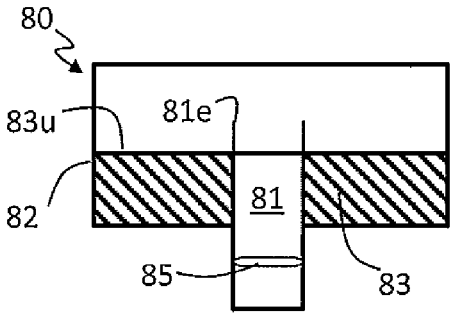
FIG. 8 is a sectional view of an eighth embodiment according to the invention.

Referring now to FIG. 8 (integers similar or identical to those of the first embodiment are identified by a preceding '8'), there is shown a further flame arrester 80 having a flame arrester element 83 connected to a housing 82. The conduit 81 may be provided with an optional extension 81*e* which, if present, will protrude beyond the upstream surface 83*u* of the flame arrester element 83. Located within the conduit 81 is a bursting or rupture disc 85. The bursting disc 85 is a single use pressure relief device arranged to activate (burst) once it is exposed to a certain pressure. Thus the bursting disc 85 protects the system from excessive pressure or vacuum and, once deployed, the flame arrester continues to protect the upstream components, for example, from the effects of an atmospheric deflagration.

The bursting disc 85 may be sited sufficiently far away from the flame arrester element 83 to seek to limit the risk that, upon deployment, fragments of the bursting disc 85 block the flame arrester element 83. Alternatively, the bursting disc can be a non-fragmenting bursting disc. Alternatively, the bursting disc 85 can be provided at either end of the conduit 81.

Figure 9:
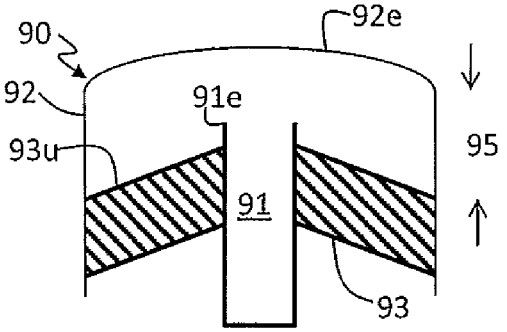
FIG. 9 is a sectional view of a ninth embodiment according to the invention.

Referring now to FIG. 9 (integers similar or identical to those of the first embodiment are identified by a preceding '9'), there is shown a further flame arrester 90 having a flame arrester element 93 connected to a housing 92. The inlet conduit 91 may be provided with an optional extension 91*e* which, if present, will protrude beyond the upstream surface 93*u* of the flame arrester element 93. The top wall 92*e* of the housing 92 may be flat or domed outwardly (as shown), domed inwardly or otherwise shaped. The wall of the housing 92 may separate the periphery of the top wall 92*e* by a certain distance 95 from the periphery of the flame arrester element 93. As shown, the flame arrester element 93 does not lie in a plane orthogonal to the principal flow axis through the inlet conduit 91. Indeed, as shown, the flame arrester element 93 describes a frusto-conical shape with the apex closest to the top wall 92*e*. However, the flame arrester element 93 may be oppositely positioned, that is as a frusto-cone with the apex furthest from the top wall 92*e*. In either case the principal flow axis for gases flowing there through may be inclined with regard to the principal flow axis along the conduit but will still have a substantial vector component in a direction opposite to that along the conduit and hence will be in a direction opposite.

Figure 10:
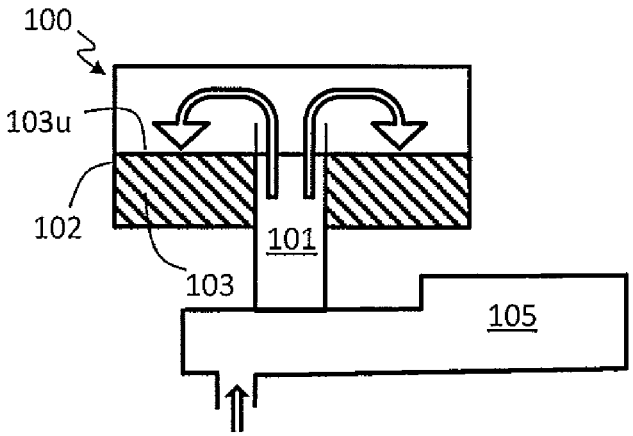
FIG. 10 is a sectional view of a tenth embodiment according to the invention.

Referring now to FIG. 10 (integers similar or identical to those of the first embodiment are identified by a preceding '10'), there is shown a further flame arrester 100 integrated with a pressure and vacuum relief valve 105, the flame arrester 100 having a flame arrester element 103 connected to a housing 102. The inlet conduit 101 may be provided with an optional extension 101*e* which, if present, will protrude beyond the upstream surface 103*u* of the flame arrester element 103.

Upstream of the flame arrester 100 is a pressure and vacuum relief valve 105. Accordingly, if the supply pressure of gas is higher than a pre-determined setting, the pressure relief valve 105 will actuate, thereby allowing gas to vent into the flame arrester 100, the flame arrester 100 providing continuous protection of the upstream equipment.

Figure 11:
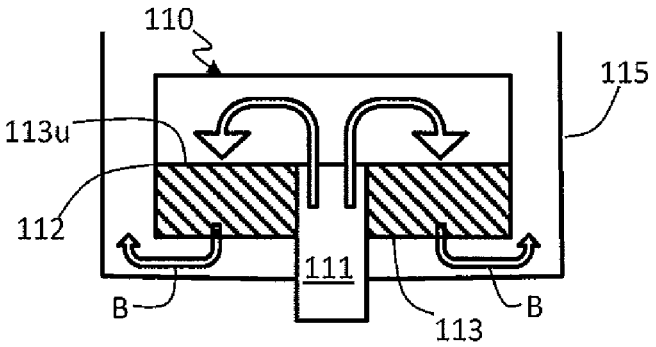
FIG. 11 is a sectional view of an eleventh embodiment according to the invention.
Figure 11A:
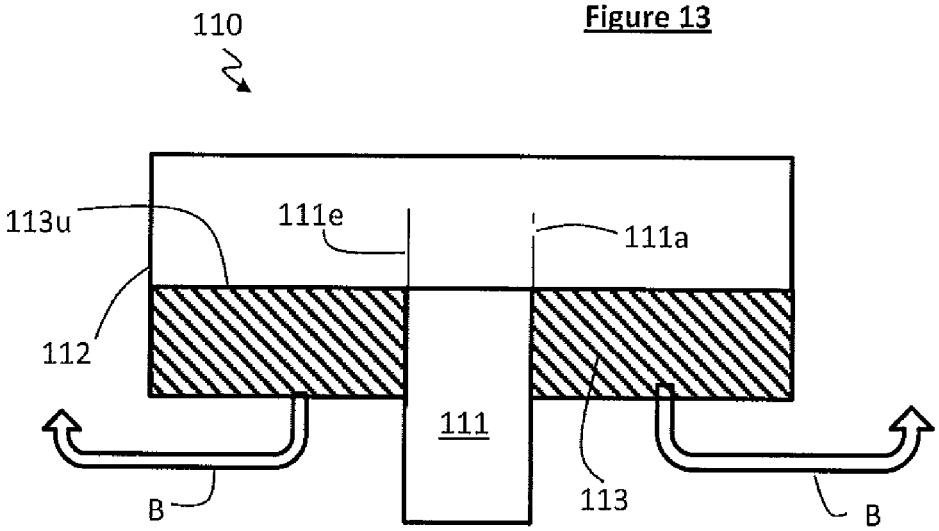
FIG. 11A is an enlarged view of a portion of FIG. 11.

Referring now to FIG. 11 and FIG. 11A (integers similar or identical to those of the first embodiment are identified by a preceding '11'), there is shown a further flame arrester 110 having a flame arrester element 113 connected to a housing 112. The conduit 111 may be provided with an optional extension 111*e* which, if present, will protrude beyond the upstream surface 113*u* of the flame arrester element 113.

The flame arrester 110 is located within a further housing 115 such that the flow of gas or vapour exiting the flame arrester element 113 will reverse again to exit the housing 115, as indicated by arrows B. Of course, the direction of flow may be in the opposite direction to that shown in FIG. 11.

As will be appreciated, the housing 115 may be of any shape or geometry and may be part of other equipment or systems. Accordingly, the flame arrester shown in FIG. 11 is an example of the present invention being used in a non-atmospheric application (i.e. in an in-line configuration rather than EOL as for FIGS. 1-10 and 13). The provision of the exterior housing 112 will protect the flame arrester 110 and the flame arrester element 113 from impacts of other deleterious incidents.

In the case where the flame arrester 110 is designed to protect against a detonation, we believe that the optional extension 111*e* is beneficial and may be very important and perhaps essential. Where present, we prefer that the extension 111*e* will have a height of at least 0.5 times the diameter (or other transverse dimension) of the conduit 111. Whilst the height of the extension 111*e* will be optimised for the particular flow characteristics of the flame arrester 110, the height will usually be equal to or less than twice the diameter of the conduit 111. In some, most or all cases, when a detonation impinges the flow volume may and preferably will be sufficient to allow the detonation to migrate to a deflagration in response to the expansion.

Further, the extension 111*e* (when present) may comprise at least one aperture 111*a* in a side wall thereof, i.e. preferably a radial aperture 111*a* with respect to the principal flow axis along the conduit 111, to allow at least a portion of inlet flame front to cause pre-combustion around the flame arrester element upstream surface 113*u*. The burnt gases in the flow volume will typically make the flame arrester element 113 work more efficiently and thus may reduce the required length of the flame arrester element 113. An extension corresponding to the extension 111*e* together with aperture(s) corresponding to the one or more apertures 111*a*, may be provided on any of the other embodiments of flame arrester embodiments forming part of the invention. The apertures will allow for pre-combustion.

Figure 12:
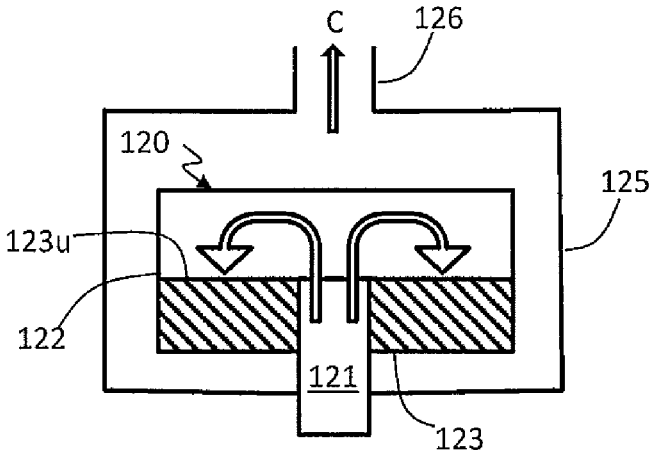
FIG. 12 is a sectional view of a twelfth embodiment according to the invention.

Referring now to FIG. 12 (integers similar or identical to those of the first embodiment are identified by a preceding '12'), there is shown a further flame arrester 120 having a flame arrester element 123 connected to a housing 122. The conduit 121 may be provided with an optional extension (not shown) which, if present, will protrude beyond the upstream surface 123*u* of the flame arrester element 123 (i.e. as is shown in respect of FIG. 11A).

The flame arrester 120 is located within a further housing 125 such that the flow of gas or vapour exiting the flame arrester element 123 will reverse again to exit the housing 125, through outlet 126, as indicated by arrow C. The outlet 126 may be part of a ductwork or other pipe system and may be located such that the flow through the outlet is parallel to or orthogonal to the principal flow axis along the conduit 121. Thus the flame arrester 120 may be deployed in line, instead of as an EOL flame arrester, for either deflagration or detonation applications and may operate in either flow direction (i.e. the conduit 121 may be an inlet or an outlet).

In the case where the flame arrester 120 is designed to protect against a detonation, we believe that the optional extension to the conduit (not shown) is beneficial and may be very important and perhaps essential. Where present, we prefer that the extension will have a height of at least 0.5 times the diameter (or other transverse dimension) of the conduit 121. Whilst the height of the extension will be optimised for the particular flow characteristics of the flame arrester 120, the height will usually be equal to or less than twice the diameter of the conduit 121. In some cases, when a detonation impinges the flow volume may or will be sufficient to allow the detonation to migrate to a deflagration in response to the expansion.

Further, the extension (when present) may comprise at least one aperture in a side wall thereof, i.e. preferably a radial aperture with respect to the principal flow axis along the conduit 121, to allow at least a portion of inlet flame front to cause pre-combustion around the flame arrester element upstream surface 123*u*. The burnt gases in the flow volume will typically make the flame arrester element 123 work more efficiently and thus may reduce the required length of the flame arrester element 123.

The flame arresters 110 and 120 shown in FIGS. 11 and 12 may both be used in applications in which a flame front may propagate through the respective inlet conduit 111 or 121. In these embodiments, the walls of the housings 112 and 122 shield the flame arrester elements 113 and 123 from direct impact from the incoming explosion, thereby increasing the quenching capability of the flame arresters. This is different to the mechanism by which the flame arresters in FIGS. 1-10 and 13 protect against vapour cloud explosions.

Indeed, the embodiments shown in FIGS. 11 and 12 may be used to protect against either deflagrations or detonations, and in particular detonations, in a pipeline system. In these applications, the inlet for flame entering the flame arrester is usually fixed, i.e. unidirectional. We believe that the principal advantage of the described embodiments is that an approaching detonation front experiences a sudden expansion as it enters the flow volume, which may convert detonation into deflagration under certain conditions. The energy and momentum of the incoming combustion front is then, at least partially, absorbed by the end wall of the flow volume (thus acting as a momentum breaker). The weakened combustion front is then reversed and passes through the flame arrester element. We further believe that the presence of the radial aperture(s) in the conduit extension allows pre-ignition of the unburnt fuel/air mixture in the flow volume close to the flame arrester element resulting in deflagration prior to the arrival of the reversed combustion front. The presence of the pre-combustion products, at least partially, inhibits the continuation of the combustion process within the reversed combustion front as it moves towards the flame arrester element. This combination of sudden expansion, momentum breaker and pre-combustion with reverse flow is, we believe, a significant improvement over existing technology.

Figure 13:
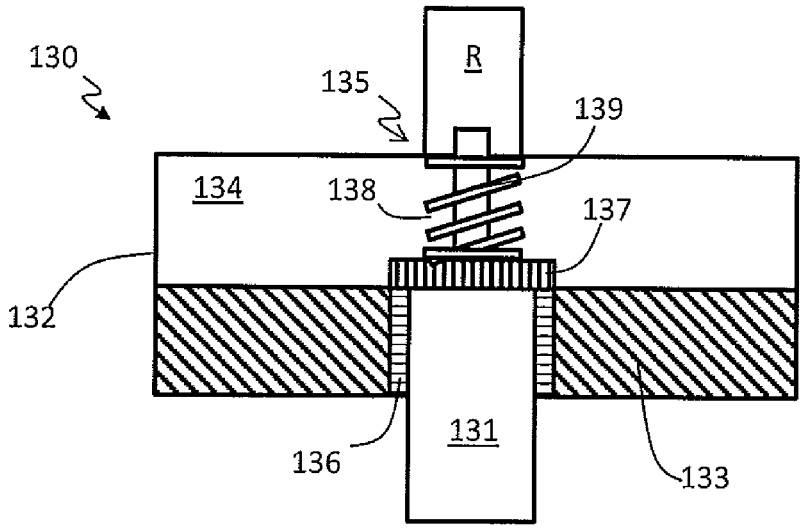
FIG. 13 is a sectional view of a thirteenth embodiment according to the invention.

Referring now to FIG. 13 (integers similar or identical to those of the first embodiment are identified by a preceding '13'), there is shown a further flame arrester 130 comprising an integral pressure relief valve 135, the flame arrester 130 having an inlet conduit 131 and a flame arrester element 133 connected to a housing 132.

The integral pressure relief valve 135 comprises a valve seat 136 and a valve pallet 137. The valve pallet 137 is resiliently urged into engagement with the valve seat 136 by the spring 138 or other urging member such as a biasing member (e.g. a weight or spring). A valve stem 139 is located on the valve pallet 137 to ensure location of the valve pallet 137. The valve stem 139 reciprocates within a barrel of a retainer R.

In use, as pressure builds up within the inlet conduit 131 the pressure will eventually overcome the resilient urging of the spring 138 to allow gas or vapour to vent into the flow volume 134 and thence through the flame arrester element 133.

The valve seat 136 need not extend along the inlet conduit 131 as shown; it may be located on the adjacent portion of the upstream surface 133*u* of the flame arrester element 133. Alternatively, the distal end of the inlet conduit 131 may provide or house the valve seat 136. For example, the distal end of the inlet conduit 131 may be flared or have a peripheral extension to provide or house the valve seat 136. It will be appreciated that the pressure relief valve 135 may be replaced or augmented by a vacuum relief valve or by a pressure and vacuum relief valve without departing from the scope of the invention.

Figure 14:
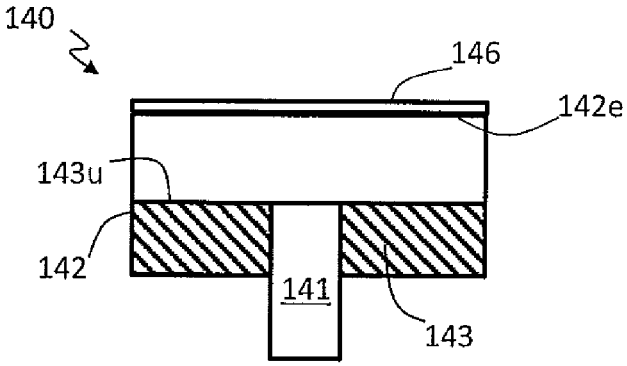
FIG. 14 is a sectional view of a fourteenth embodiment according to the invention.

Referring now to FIG. 14 (integers similar or identical to those of the first embodiment are identified by a preceding '14'), there is shown a further flame arrester 140 comprising a lid 146, the flame arrester 140 having an inlet conduit 141 and a flame arrester element 143 connected to a housing 142.

The lid 146 is included in the top wall of the housing 142 in this embodiment, however it may be located in any suitable portion thereof. The lid 146 may be releasably attached to the housing 142 by attachment means (not shown), such that the lid 146 may be opened and/or removed, for example during use and/or during inspection and/or maintenance of the flame arrester 140. The attachment means may include releasable attachment means (for example, clips, catches, and the like) and/or non-releasable attachment means (for example, hinges). The lid 146 may include a weight, e.g. a weight sufficient to maintain or substantially maintain its position relative to the housing 142 during normal operation of the flame arrester 140. Most preferably the lid 146 includes sealing means (not shown) configured to seal the lid 146, e.g. an entire periphery thereof, against or relative to the housing 142.

If the flame arrester element 143 becomes blocked and gas continues to flow through the inlet conduit 141 the pressure within the housing 142 may increase towards potentially dangerous levels. The lid 146 may be configured to operate as a pressure relief valve, for example to mitigate against such pressure increases, e.g. the lid 146 may be automatically opened and/or removed if the pressure (for example of gas) within the housing 142 exceeds a prescribed value. Under such circumstances the lid 146 may advantageously provide pressure relief means (i.e. or for example it may act as an emergency vent), thereby protecting the flame arrester 140 and/or upstream piping work or equipment from potentially explosive damage. Alternatively, the pressure within the housing 142 may be monitored, for example by a sensor (not shown), and the lid 146 may be manually opened and/or removed when required. It will be appreciated that manually opening and/or removing the lid 146 may entail the use of an actuator or tool (not shown) which may be remotely operated.

The lid 146 may also be opened and/or removed during maintenance and/or inspection of the flame arrester 140. Advantageously, use of such a lid 146 may mitigate against the need to remove the flame arrester element 143 prior to maintenance and/or inspection thereof. Furthermore, opening and/or removal of the lid 146 may allow the instillation and/or replacement of articles into the housing 142. For example, mesh pads may be installed and/or replaced adjacent the inlet conduit 141 in order to filter undesirable matter, e.g. dirt, liquid and/or particulates. The lid 146 may provide access for maintenance and/or replacement of further features within the flame arrester 140, for example a liquid collector (as shown in the embodiment of FIG. 2), a particulates trap (as shown in the embodiment of FIG. 3), a cleaning means such as nozzles (as shown in the embodiment of FIG. 4), etc.

Figure 15:
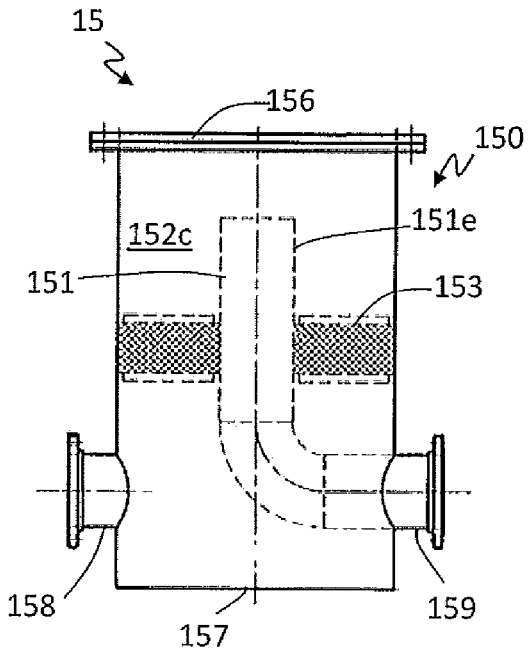
FIG. 15 is a sectional view of a further embodiment of flame arrester according to the invention.

Referring now to FIG. 15 (integers similar or identical to those of the first embodiment are identified by a preceding '15') there is shown a flame arrester 15 including a flame arrester housing 150 having a manifold 157.

The flame arrester 15 includes a chamber 152*c* and an inlet conduit 151 (with an optional extension 151*e*). The manifold 157, which includes an outlet passageway 158 and an inlet passageway 159, is fluidly connected to the chamber 152*c* and is most preferably integrally formed therewith. The inlet passageway 159 is fluidly connected to the inlet conduit 151, orthogonally to a principal flow axis extending along the inlet conduit 151. The outlet passageway 158 is oriented so that gas flow therethrough is orthogonal to the principal flow axis of the flame arrester element 153. The outlet passageway 158 is located on the manifold 157 such that it is aligned with the inlet passageway 159. Additionally or alternatively, the outlet passageway 158 and/or the inlet passageway 159 may be oriented at any suitable orientation relative to, respectively, the principal flow axis of the flame arrester element 153 and/or the principal flow axis extending along the inlet conduit 151. The inlet passageway may include apertures, for example located through a part of the extension 151*e*, for example as described above in relation to FIG. 11A.

The flame arrester 15 may provide means whereby the flame arrester 15 may be deployed in line or as an EOL flame arrester, for either deflagration or detonation applications and may operate in either flow direction (i.e. the inlet passageway 159 may be an inlet or an outlet).

Figure 16:
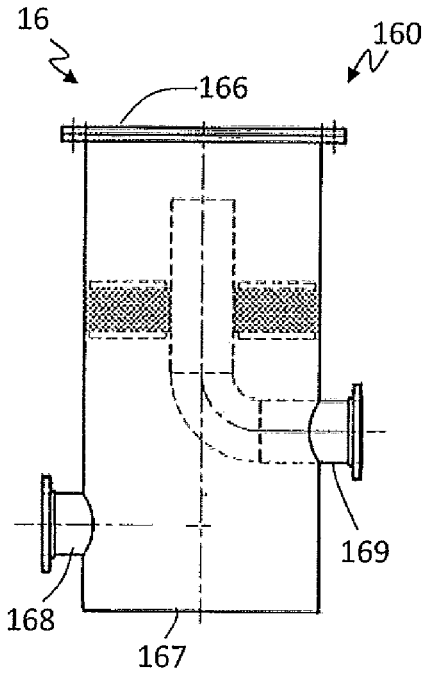
FIG. 16 is a sectional view of a yet further embodiment of flame arrester according to the invention.

Referring now to FIG. 16 (integers similar or identical to those of the first embodiment are identified by a preceding '16'), there is shown a flame arrester 16 including a flame arrester housing 160 having a manifold 167 in which the inlet passageway 169 and outlet passageway 168 are offset from one another (e.g. not aligned).

Figure 17:
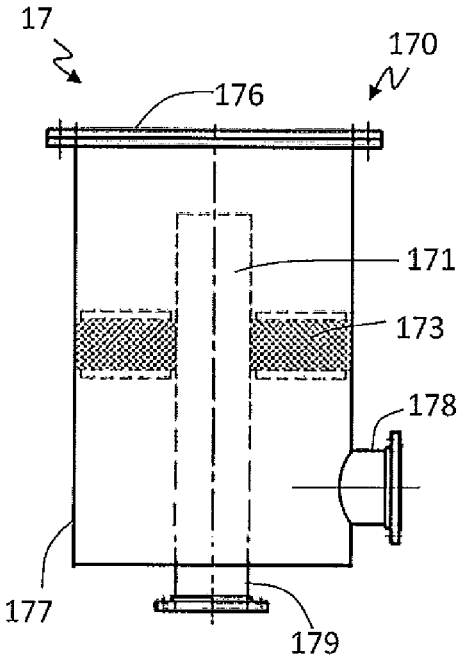
FIG. 17 is a sectional view of a still further embodiment of flame arrester according to the invention.

Referring now to FIG. 17 (integers similar or identical to those of the first embodiment are identified by a preceding '17'), there is shown a flame arrester 17 including a flame arrester housing 170 having a manifold 177. The inlet passageway 179 is parallel and aligned with the principal flow axis extending along the inlet conduit 171 in this embodiment, whilst the outlet passageway 178 is oriented so that gas flow therethrough is orthogonal to the principal flow axis of the flame arrester element 173. This flame arrester 17 therefore provides an arrangement whereby gas flowing into the flame arrester 17 (through either the inlet passageway 179 or the outlet passageway 178) will flow out thereof at a diverted angle of about 90 degrees (through either the outlet passageway 178 or the inlet passageway 179). It will be appreciated that the inlet passageway 179 and/or outlet passageway 178 may be positioned and/or oriented relative to the manifold 177 and/or to one another in order to provide a diversion angle which may be more or less than 90 degrees.

Figure 18:
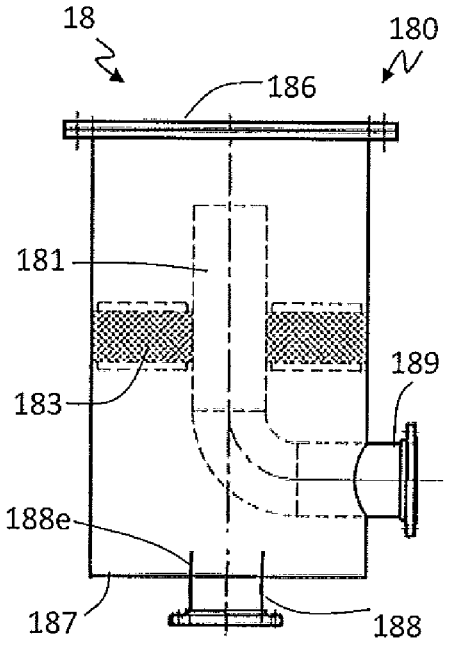
FIG. 18 is a sectional view of a yet further embodiment of flame arrester according to the invention.

Referring now to FIG. 18 (integers similar or identical to those of the first embodiment are identified by a preceding '18'), there is shown a flame arrester 18 including a flame arrester housing 180 having a manifold 187. The inlet passageway 189 is orthogonal to the principle flow axis extending along the inlet conduit 181, whilst the outlet passageway 188 is parallel to the principle flow axis of the flame arrester element 183. The outlet passageway 188 may include an extension 188*e* which extends into the manifold 187. Advantageously, in use, this extension 188*e* may act to prevent passage of undesirable matter, for example cleaning fluid or particulate matter, from within the manifold 187 into the outlet passageway 188*e*.

In any of the embodiments shown in FIGS. 15 to 18, the uppermost surface 156, 166, 176, 186 may be formed as a lid (as per the embodiment of FIG. 14) or as a fixed surface. A lid (or other openable part) is preferred to enable and facilitate cleaning and/or maintenance. In any and all of these embodiments a lid may allow the instillation and/or replacement of articles into the respective housing. For example, mesh pads may be installed and/or replaced adjacent the inlet conduit in order to filter undesirable matter, e.g. dirt, liquid and/or particulates. The lid may provide access for maintenance and/or replacement of further features within the flame arrester, for example a liquid collector (as shown in the embodiment of FIG. 2), a particulates trap (as shown in the embodiment of FIG. 3), a cleaning means such as nozzles (as shown in the embodiment of FIG. 4), and so on and such means may be mounted on or to the lid.

In any and all embodiments described above, the flame arresters may be installed in different orientations, for example the flame arresters may be oriented at 90° or 180° to that shown (or indeed at any other angle).

As will be appreciated, features of each of the above embodiments may be combined within a single flame arrester. For example, it is quite conceivable that any of the above-described features and/or the following features may be included in or with the first embodiment of the present invention: an conduit extension, a fluid drain, a porous particulate trap, cleaning nozzles, a curved or other shape housing, an eccentrically-arranged conduit and an expansion fitting.

In the above description, the conduit is described as having a preferable extension, for example integer 51*e* in FIG. 5. Whilst the extension will often be integral with the conduit, it need not be; the two could be formed as separate parts joined or secured together.

Moreover, the extension may be mounted to the flame arrester element or to another part and may or may not be concentric with the conduit and may or may not have the same internal cross sectional shape and/or area as the conduit.

One or more of the internal walls of the or each housing may be provided with formations to encourage flow in a particular direction, for example baffles or other flow diverters may be used.

The height of the conduit extension may be chosen such that, for example, fluid flow within the flow volume is controlled and/or distributed towards, say, a drain or porous particulate trap.

In each case, the housing may be capable of being disconnected from the flame arrester element to allow replacement or to facilitate inspection and/or maintenance.

In all cases described above, the conduit has a length greater than the thickness of the flame arrester element, such that it extends through and protrudes beyond the flame arrester element on at least one side and preferably both sides of the flame arrester element. At the upstream end (in 'normal', out-breathing mode) of the conduit it may be provided with fittings to facilitate installation in a pipework or ducting system.

As will be appreciated, the flame arrester of the invention can be deployed in place of the cumbersome goose neck arrangement of the prior art and, as such, they are easier to install, less costly and facilitate further functionality, such as the provision of means for the removal of entrained liquid and/or solids from the gas or vapour stream. Also, for flame arresters which are intended for use at low flow rates, the dimensions of the flame arrester element can be reduced such that the free area of the flame arrester element is equal to or less than the cross-sectional area of the conduit. This helps to reduce significantly the size (and cost) of the flame arrester. Moreover, because of the clever and neat design, the flame arrester of the invention need not be removed from the pipework or ducting to which they are connected during maintenance and/or inspection, further increasing the benefit to the operator. Moreover, in situ cleaning of the flame arrester need not introduce cleaning or other fluids into the upstream and/or downstream pipework to which the flame arrester is connected.

The flame arrester of the invention may be provided with a heating blanket or other heating means to ensure that the flame arrester element does not become blocked due to freezing.

Each of the flame arresters described above, and falling within the scope of the invention, may be preferably of circular or rectangular form when viewed in plan, but are not limited to these shapes.

The invention claimed is:

1. A flame arrester, the flame arrester having a housing comprising an end wall and a side wall extending from the end wall, and in which housing there is provided a flow volume, a flame arrester element and in which housing extends a first conduit and a second conduit, the second conduit being defined between the first conduit and the side wall, along at least a portion of the first conduit the first conduit is surrounded by the flame arrester element, the flame arrester element being within the second conduit and extending from the first conduit to contact the side wall of the housing, and wherein the first conduit has a principal flow axis extending along the first conduit for free flow of gas into and out of the flame arrester and into and from the flow volume and the flame arrester element has a principal flow axis for flow of gas along the second conduit and to and from the end of the first conduit out of and into the flow volume within the housing, the principal flow axis along said portion of the first conduit and the principal flow axis through the flame arrester element extending in opposite directions, the first conduit and the second conduit being in free fluid communication such that gas flowing into the housing of the flame arrester passes through the flame arrester element into the flow volume and into the first conduit and wherein the first conduit has a cross sectional area A and, at a working surface, the flame arrester element has a cross sectional area of A or above.

2. A flame arrester according to claim 1, wherein the flame arrester element is located concentrically or eccentrically around the conduit.

3. A flame arrester according to claim 1, wherein at least a portion of the flame arrester element is inclined with respect to the principal flow axis along the conduit.

4. A flame arrester according to claim 3, wherein the flame arrester element has a frusto-conical shape, flaring inwardly or outwardly with respect to the principal flow axis.

5. A flame arrester according to claim 1, wherein the conduit comprises an extension which protrudes beyond the flame arrester element.

6. A flame arrester according to claim 5, wherein the extension protrudes into a flow volume provided between facing surfaces of the flame arrester element and the end wall of the housing.

7. A flame arrester according to claim 6, wherein the extension protrudes into the flow volume by a distance of from 0.3 to 3 times a transverse dimension of the conduit.

8. A flame arrester according to claim 5, wherein the extension comprises one or more apertures.

9. A flame arrester according to claim 1, wherein the conduit comprises a flow restriction along its length.

10. A flame arrester according to claim 9, wherein the conduit comprises a flow restriction at or about a terminal portion thereof and the flow restriction or the conduit comprises one or more through holes.

11. A flame arrester according to claim 1, comprising one or more of a solids trap, a liquid drain, cleaning nozzles arranged to discharge a cleaning medium into the flow volume and/or through the flame arrester element.

12. A flame arrester according to claim 1, wherein the housing comprises two parts, a first part in which the flame arrester element is located and a second part, the two parts being permanently or releasably secured together.

13. A flame arrester according to claim 1, wherein the conduit has an external diameter D and/or a cross sectional area A, and the flame arrester element has an external diameter of at least 2.25 D, and/or a cross sectional surface area across at least one of its surfaces of 2A, 3A or 4A.

14. A flame arrester according to claim 1, the flame arrester being at least partially located within an exterior housing.

15. A flame arrester according to claim 14, wherein the conduit extends through an exterior housing, the exterior housing further comprising a second conduit, gas being able to flow via the first conduit through the flame arrester and thence to the second conduit.

16. A flame arrester according to claim 1, wherein the flame arrester element comprises a laminate of crimped and flat ribbon secured to the conduit, the laminate being wound around the conduit with the end of the laminate being secured to a preceding layer thereof.

17. A flame arrester according to claim 16, wherein the conduit extends on at least one side of the flame arrester element to provide an extension portion which protrudes into a flow volume provided between facing surfaces of the flame arrester element and an end wall of the housing.

18. A flame arrester according to claim 17, wherein the extension protrudes into the flow volume by a distance of from 0.3 or 0.4 to 3 times the transverse dimension of the conduit.

19. A flame arrester according to claim 16, wherein the flame arrester element flares inwardly or outwardly from the conduit with respect to the principal flow axis.

20. A flame arrester, the flame arrester having a housing comprising an end wall and a side wall and in which housing there is provided a flow volume, a flame arrester element and in which housing extends a conduit, along at least a portion of the conduit the conduit is surrounded by the flame arrester element, the flame arrester element extending from the conduit to contact the side wall of the housing, and wherein the conduit has a principal flow axis extending along the conduit for free flow of gas into and out of the flame arrester and into and out of the flow volume and the flame arrester element has a principal flow axis for flow of gas to and from the end of the conduit out of and into the flow volume within the housing, the principal flow axis along said portion of the conduit and the principal flow axis through the flame arrester element extending in opposite directions, wherein there is provided a free flow gas passage from the flame arrester element to the conduit such that, in use, gas flowing into the housing of the flame arrester passes through the flame arrester element into the flow volume and into the conduit.

* * * * *